United States Patent [19]

Pawloski et al.

[11] Patent Number: 4,571,975

[45] Date of Patent: Feb. 25, 1986

[54] FLUID ACTUATED TOOL

[76] Inventors: James A. Pawloski, 189 Durfee St.; Grahame F. Williams, 801 South St., both of Southbridge, Mass. 01550

[21] Appl. No.: 594,787

[22] Filed: Mar. 29, 1984

[51] Int. Cl.[4] ..... B21D 28/10; B21D 28/14; B21D 28/20

[52] U.S. Cl. ..... 72/325; 72/407; 72/452; 72/453.18; 81/90.2; 137/625.68; 29/21.1; 30/368

[58] Field of Search ..... 72/407, 409, 410, 325, 72/324, 452, 445, 453.18, 453.19; 81/57, 54, 91 R, 91 A, 90.2; 137/625.68; 29/21.1, 432; 30/368, 358, 128

[56] References Cited

U.S. PATENT DOCUMENTS

| | | | |
|---|---|---|---|
| Re. 26,834 | 3/1970 | Pawloski | 72/452 |
| 345,687 | 7/1886 | Hayes | 72/325 |
| 955,386 | 4/1910 | Crossman | 72/409 |
| 2,396,562 | 3/1946 | Forss | 72/409 |
| 2,531,511 | 11/1950 | Hill | 137/625.68 |
| 2,653,664 | 9/1953 | Dolby | 72/325 |
| 3,068,485 | 12/1962 | Lingle et al. | 72/407 |
| 3,504,436 | 4/1970 | Ebert | 30/368 |
| 3,511,072 | 5/1970 | Oddy | 72/464 |
| 3,612,114 | 10/1971 | Pawloski | 72/331 |
| 3,772,907 | 11/1973 | Rider | 72/452 |
| 3,821,890 | 7/1974 | Dewey | 72/325 |
| 3,877,280 | 4/1975 | Cornell | 72/325 |
| 3,925,875 | 12/1975 | Doke | 29/21.1 |
| 3,972,218 | 8/1976 | Pawloski | 72/407 |

FOREIGN PATENT DOCUMENTS

| | | | |
|---|---|---|---|
| 6357 | 2/1904 | Denmark | 72/325 |
| 518867 | 3/1940 | United Kingdom | 137/625.68 |

*Primary Examiner*—Daniel C. Crane
*Attorney, Agent, or Firm*—Arthur T. Fattibene

[57] ABSTRACT

A fluid actuated tool for securing together sheet metal parts comprising a power pack unit including a piston and cylinder assembly to which there is connected a jaw housing having a pair of complementary jaw members that are actuated between operative and inoperative positions by a ram connected to a piston reciprocally mounted in the cylinder of the power pack unit. The respective jaw members include complementary work engaging portions in the form of a piercing blade and complementary blade slot which function to pierce the metal parts and curl the displaced metal to positively secure the metal parts together. A valve is disposed in the power pack unit to control the flow of actuating fluid to and from the cylinder to effect the displacement of the piston to activate the jaw member, and a handle is connected to the power pack unit to facilitate the operation thereof.

1 Claim, 14 Drawing Figures

FIG. 3
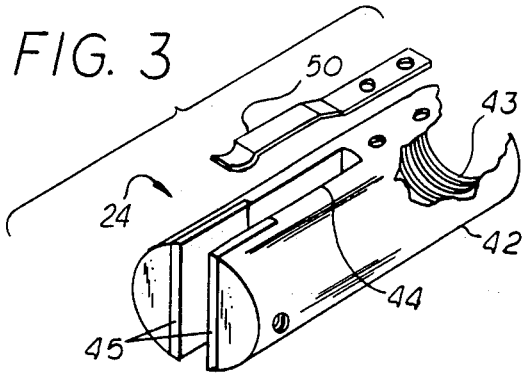
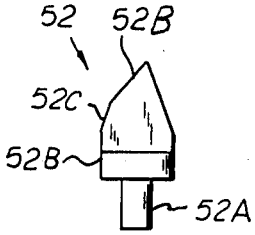
FIG. 4
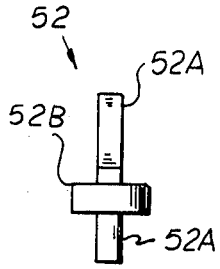
FIG. 5
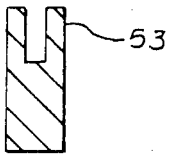
FIG. 6
FIG. 7
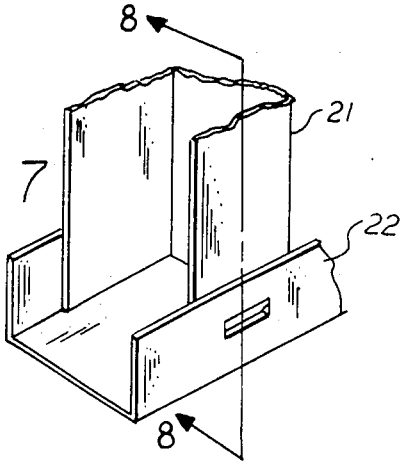
FIG. 8
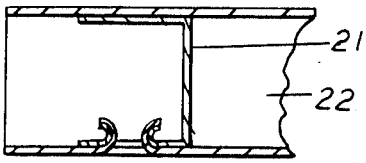
FIG. 9
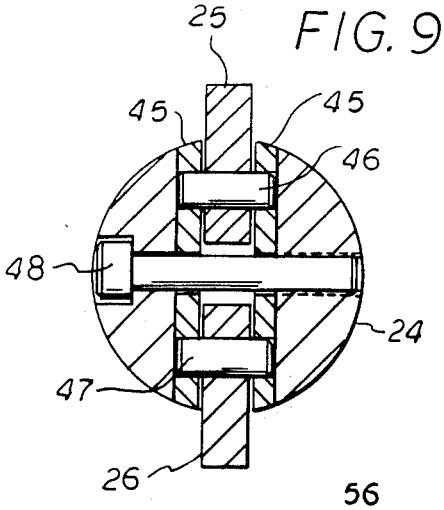
FIG. 11
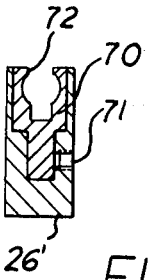
FIG 10
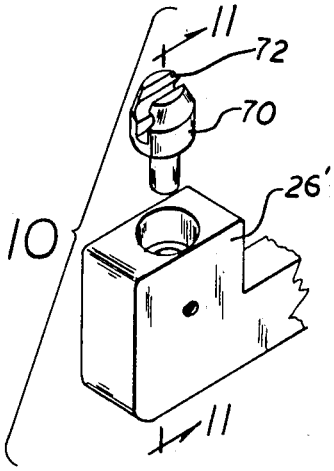
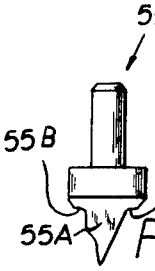
FIG. 12
FIG. 13
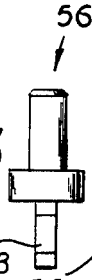
FIG. 14
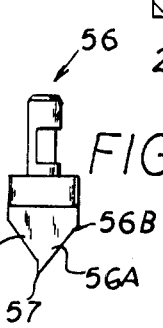

FLUID ACTUATED TOOL

FIELD OF THE INVENTION

This invention relates generally to a fluid activated tool, e.g. a pneumatically operated tool which comprises an improvement over the tools disclosed in one of the Applicant's line of prior U.S. Pat. Nos. 3,199,337; 3,269,223; 3,552,451; 3,612,114; 3,654,700; 3,765,087; 3,972,218; and more specifically to a tool for securing together in a positive manner sheet metal parts by effecting a piercing and curling of the displaced material to effect the securement.

PURPOSE OF THE INVENTION

In the construction and building industry, the materials and methods of construction have changed considerably. Framing and other construction jobs were once exclusively done with wood. The introduction of new materials and building costs have changed the construction industry. Therefore, to reduce cost and improve construction techniques, the use of metal fabricated framing members are being adapted to uses where wood has once been used exclusively. With the adaptation of such new metal framing techniques, the old methods of securing them together with fasteners, such as screws or rivots, became difficult to apply, and time consuming. It is obvious that nails cannot be used with metal. The use of conventional bolts, screws or rivots present several disadvantages. Most notably was the delay in time required to secure the metal parts with such fasteners. The available fastening techniques required at least two steps; the operation of drilling a hole and the subsequent operation of inserting a fastening device. Not only was this a time consuming operation, but often resulted in problems of aligning the drilled holes in the parts to be secured prior to inserting the fastening device. This invention relates to providing a solution to the problems heretofore presented by the increasing use of a metal framing in the construction and building industry.

OBJECTS

It is an object of this invention to provide a fluid operated piercing and curling tool that will expedite the securing of metal framing components.

Another object is to provide a fluid activated tool whereby the speed and efficiency of construction is increased.

Another object is to provide a fluid activated tool that can be used on the metal fabricated members which are being increasingly used in the construction industry.

Another object is to provide a fluid activated tool that will pierce and form the displaced material to define a positive and permanent connection.

Another object is to avoid the need of conventional types of fasteners, such as bolts, rivets or screws to secure metal parts.

Another object is to provide a tool that is simple and easy to use.

SUMMARY OF THE INVENTION

This invention relates to a fluid actuated tool, e.g. air actuated, for securing together in a simple and positive manner fabricated metal framing components, the use of which is gaining favor in the building trades. The tool comprises a power pack unit which includes a piston and cylinder assembly and a valve assembly for controlling the flow of activating fluid into the cylinder to sequentially activate the piston to a protracted and retracted position, the valve assembly controlling the direction and flow of the activating fluid into and out of the cylinder to effect the operation of the piston and connected piston rod.

Connected to the power pack unit is a jaw housing on which a pair of complementary jaw members are pivotally mounted and operatively associated with a ram mounted on the piston rod for movement between an operative and inoperative position as the piston is protected and retracted accordingly. In accordance with this invention, the ends of the jaw member are provided with complementary work engaging portions which includes a piercing blade connected to one jaw member, and a complementary blade slot connected to the other jaw member. The piercing blade is specially constructed so that it will piece the component metal parts and effect a curling of the displaced material to form a positive bond or attachment between the metal parts; as the jaws close onto the metal parts. A spring is interposed between the work engaging portions of effect positive separation of the piercing blade from its complementary receiving slot; and the metal components secured thereby.

A handle is suitably connected to the end of the power pack unit to facilitate the handling and manipulation of the tool.

FEATURES

A feature of this invention resides in a fluid actuated tool that can be hand held while being positioned and operated.

Another feature resides in the ease with which metal fabricated framing can be made secured and the saving of considerable time over the conventional methods used to secure such metal framing.

Another feature resides in a fluid activated tool having a pair of jaw members formed with complementary work engaging portions that function to pierce and curl the displaced material to effect a simple and positive connection between two adjacent metal parts to be joined.

Another feature resides in a power pack having a valve assembly for controlling the direction and flow of activating fluid into and out of a piston chamber so as to effect the drive of the piston in either direction by fluid pressure.

Other features and advantages will become more readily apparent when considered in view of the drawings in which:

FIG. 3 is a detail perspective view of the jaw housing.

FIG. 4 is a detail side view of the piercing and curling blade.

FIG. 5 is an end view of the piercing and curling blade.

FIG. 6 is a section view taken on line 6—6 of FIG. 1.

FIG. 7 is a perspective view illustrating the securement of two fabricated members made by the tool.

FIG. 8 is a detail sectional view of the securement taken on line 8—8 of FIG. 7.

FIG. 9 is a sectional view taken on line 9—9 of FIG. 1.

FIG. 10 is a partial perspective view of a modified jaw construction.

FIG. 11 is a section view taken along line 11—11 on FIG. 10.

FIG. 12 is a modified piercing blade construction.

FIG. 13 is an end view of another modified blade construction.

FIG. 14 is a side view of the blade construction of FIG. 13.

DETAILED DESCRIPTION

Figure 1:
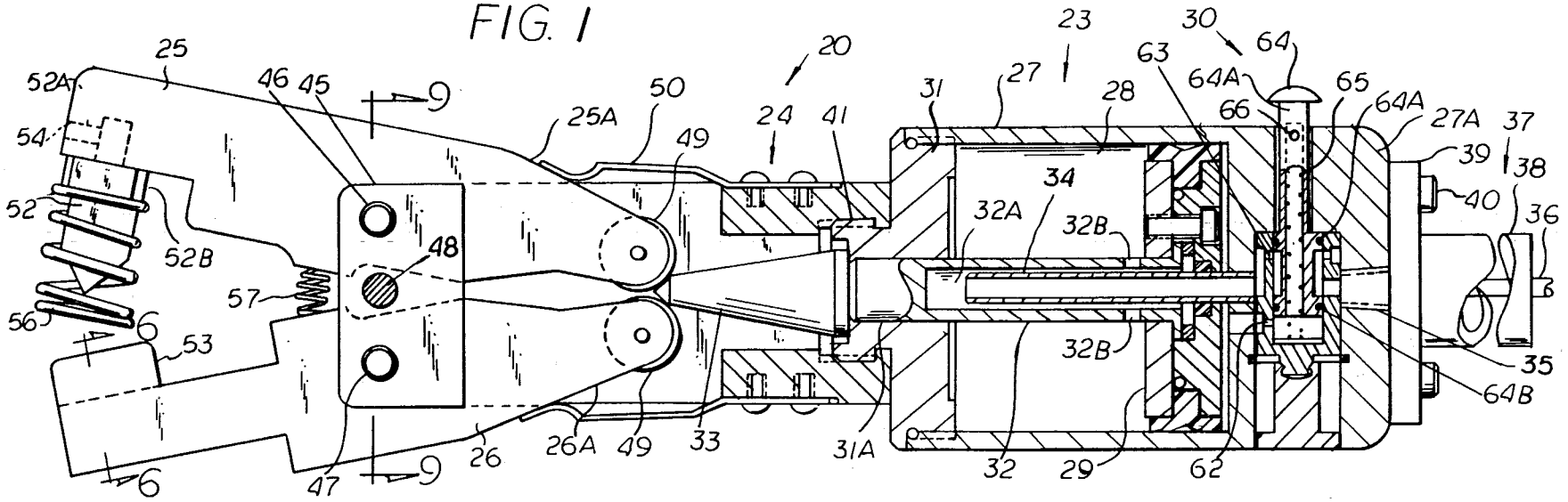
FIG. 1 is a longitudinal cross section of the invention wherein the parts are shown in the inoperative position.

Referring to the drawings, there is shown a fluid actuated tool 20 embodying the invention. The illustrated tool 20 is particularly useful in positively securing together fabricated metal component parts, and more particularly metal framing members e.g. metal channels and/or angles that are gaining favor in the building trades. As shown in FIGS. 7 and 8, metal framing members in the form of channels 21 and 22 are being substituted for wood studs and/or framing in the construction industry for a variety of reasons. To positively secure such metal framing parts, e.g. 21 and 22 to each other, a fluid actuated tool, as will be hereinafter described, is provided.

Figure 2:
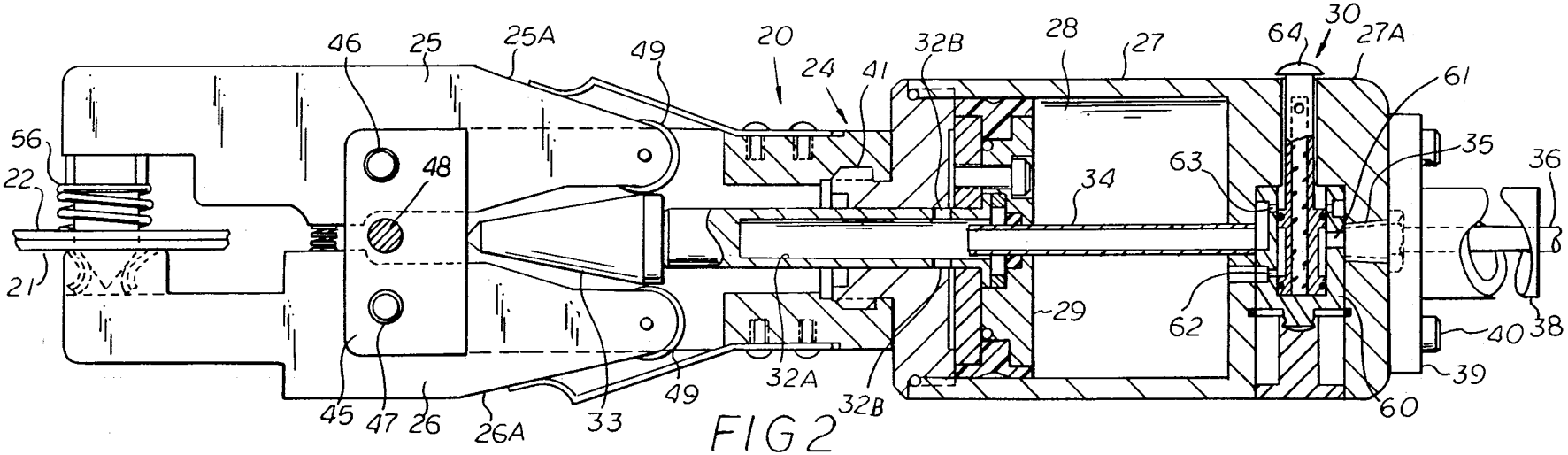
FIG. 2 is a longitudinal cross section of the invention wherein the parts are shown in the operative position.

As shown in FIGS. 1 and 2, the tool 20 comprises a power pack unit 23, a connected jaw housing 24 and a pair of complementary jaw members 25 and 26 pivotally connected for movement between operative and inoperative position.

The power pack unit 23 comprises a cylinder housing 27 defining a chamber 28 in which a piston 28 is displaceably positioned. The cylinder housingg 27 is closed by an end wall 27A which is of suitable thickness for housing therein a valve assembly 30, as will be hereinafter described, for controlling the fluid flow of activating fluid into and out of the cylinder chamber 28 to activate the piston 29. The front or open end of the cylinder chamber 28 is closed by a closure plate 31 which is provided with a central opening 31A for receiving a piston rod 32 which is connected to the piston 29. Accordingly, the piston rod 32 is moved between a protracted position as shown in FIG. 2 and a retracted position as shown in FIG. 1, as the piston 29 is displaced within its cylinder chamber 28, as will be hereinafter described. Connected to the free end of the piston rod 32 is a ram 33 formed with an inclined surface which will function to activate the jaw member as will be described. The piston rod 32 is provided with a longitudinally extending bore 32A which is disposed in telescoping relationship with a guide tube 34 which extends into the cylinder chamber 28 and which has one end connected in communication with the valve assembly 30. The piston rod 32 is also provided with one or more ports 32B which connects the bore 32A in communication with the chamber 28; and which port 32B is adjacent the piston 29. The end wall 27A is provided with a fluid inlet 35 to which a fluid supply line 36 is connected. In the illustrated embodiment, the activating fluid is compressed air. However, a liquid fluid conceivably can also be used as an activating fluid.

Connected to the end wall 27A of the power pack 23 is a handle means 37. The illustrated handle means 37 comprises a tubular rod 38 which is connected to a mounting plate 39 that is suitably secured to the end wall 27 A by suitable fasteners 40. If desired, a suitable hand grip may be mounted on the handle rod 38.

The front closure plate 31 is provided with a threaded boss 41, to which the jaw housing 24 is threadably connected. As best seen in FIG. 3, the jaw housing 24 comprises a tubular member 42 having a threaded end 43, whereby it can be secured to the boss 41 of the power pack unit. The forward end 44 of the jaw housing is bifurcated, as shown in FIG. 3.

The jaw assembly, as will be described, is fitted into the bifurcated end portion of the jaw housing. The jaw assembly, according to this invention, comprises a pair of mounting plates 45, between which the respective jaw members 25 and 26 are individually pivoted intermediate the ends thereof by respective pivots 46 and 47. The mounting plates 45 with the jaws 25 and 26 pivoted thereto are positioned in the bifurcated end portion 44 and pinned therebetween by a pin 48.

Connected to the respective inner end of each jaw member is a cam roller 49 which are arranged to engage the cam surface of the ram 33 when the latter is protracted to activate the jaw members 25, 26 as shown in FIG. 2. The inner end of the respective jaw members 25 and 26 are each provided with an inclined edge 25A, 26A, upon which a leaf spring 50 bears to normally bias the jaw members 25, 26 to their open inoperative position as shown in FIG. 1.

Connected to the respective free ends of the jaw members 25, 26 are complementary work engaging means. As shown, the work engaging means comprise a piercing blade 52 connected to one jaw member, e.g. 25 and a complementary blade slot 53 is formed on the end of the other jaw member 26.

As best seen in FIGS. 4 and 5, the piercing blade 52 is provided with a mounting end portion 52A by which it is detachably secured to the end of jaw member 25 by a set screw 54. As shown, the blade is generally flat having inclined side edges to define a blade contour that will permit the blade 52 to pierce the metal parts to be secure while causing the blanked or displaced metal to curl as best seen in FIG. 8, as the jaw members are actuated. As best seen in FIGS. 4 and 5, the blade 52 is also provided with a flange 52B which defines a seat for a relatively heavy duty coil spring 56 disposed about the blade. As best seen in FIG. 2, the coil spring 56 functions to apply a force on the metal parts 21, 22 when the jaws close to form the securement and which will also permit the jaw members to break freely from the fabricated joined metal parts upon the opening of the jaws.

If desired, an additional spring 57 may be interposed at a mid-point between the respective jaw membes 25, 26.

The valve assembly 30 comprises a valve body 60 having an inlet port 61 disposed in communication with the fluid inlet 35. The valve body 60 is also provided with oppositely disposed ports 62 and 63, which are valved by a spool valve 64. The valve spool 64 has spaced apart sealing rings 64A, 64B for sequentially valving ports 62 and 63 in and out of communication with the port 61 to control the flow of fluid into and out of the chamber 28 to control the displacement of the piston 29 accordingly. Port 63 is in communication with the guide tube 34 and port 62 is in communication with chamber 28. The spool valve 64 is also provided with a hollow stem 64A in which a spring 65 is disposed to normally bias the valve stem 64A in the up position as shown in FIG. 1. The valve stem 64A is also provided with a lateral port 66 for exhausting the evacuating portion of chamber 28 to atmosphere, as will be hereinafter described.

The tool 20 thus described can effectively and efficiently secure metal framing elements as noted in FIGS.

7 and 8 by disposing the parts to be joined between the open jaw members and by depressing the valve stem 64 as shown in FIG. 2 to cause the activating fluid to enter into the chamber 28 to the right of the piston 29 to move the piston to the left as seen in FIG. 2 and protract the ram 33 which will cam the jaw members closed, causing the piercing blade 52 to pierce the metal components 21 and 22. Due to the shape of the blade 52, the metal displaced by the piercing action curls as seen in FIG. 8 to form the connection or bond. The portion of the chamber 28 to the left of the piston 29 is exhausted to atmosphere through port 32B, piston rod bore 32A, guide tube 34, port 63 to the valve body 60, and thence through the space about the valve stem to atmosphere.

Upon release of the operating force on the valve stem 64A, upon completion of a securing operation, the valve spring 65 forces the spool valve to the up position as shown in FIG. 1, causing the spool valve to place the fluid inlet port 61 in communication with port 63 which connected with guide tube 34 to direct the fluid through bore 32A and port 32B and into the chamber 28 on the left side of the piston as shown in FIG. 1 to effect the retraction of the ram 33 and the movement of the jaws to the open position. The portion of the chamber to the right of the piston 29 is exhausted to atmosphere through port 62 which communicates with the hollow of the valve stem, whereby it is exhausted to atmosphere through port 66.

From the foregoing, it will be apparent that the tool is activated in both directions by fluid, i.e., air pressure, to open and close the jaw members, each being provided with specifically constructed work engaging portions that will pierce and bond two or more fabricated metal parts.

To equalize the degree of curling which is effected by the piercing blade, as herein described, the outermost edge may be variably angled relative to the inner edge, as best seen in FIG. 4 at 52B and 52C.

FIGS. 10 and 11 illustrate a modified jaw member 26'. In this form of the invention, the jaw member 26' is provided with a removable die slot 70. As shown, the die slot 70 is defined as an insert which can be detachably connected to the jaw member 26' by a set screw 71. As hereinbefore described, the insert or die slot 70 is provided with a groove or slot 72 for accommodating a piercing blade, as hereinbefore described.

FIG. 12 illustrates a modified blade construction 55. The blade or nose portion 55A is constructed with offset shoulders 55B and inclined side edges which converge to define a piercing nose as shown.

FIGS. 13 and 14 illustrate another modification of blade construction 56. In this form, the blade portion 56A is provided with tapering side edges 56B wherein one edge is longer than the other to define a piercing nose or point 57 as shown. It has been determined that a blade constructed as shown in FIGS. 12 to 14 is better suitable for use heavier gauge material. In all other respects, the constructional details of FIGS. 10 to 14 function in the tool assembly as hereinbefore described.

While the invention has been described with respect to a particular embodiment thereof, variations and modifications may be made without departing from the spirit or scope of the invention.

What is claimed is:

1. A fluid activated tool for securing together sheet metal parts comprising a fluid actuated power pack, said power pack comprising a cylinder housing having an end wall and defining a piston chamber, said chamber having an open end portion, a closure for sealing said open end, a piston reciprocally mounted in said chamber, a piston rod connected at one end to said piston, said piston rod extending through an opening in said closure, and said piston rod having a bore extending longitudinally thereof, a port opening communicating said bore with the interior of said chamber, said port opening being disposed adjacent said piston, a ram having an inclined surface connected to the other end of said pisto rod, means defining a fluid inlet formed in said end wall, a valve means disposed in said end wall for controlling the flow of actuating fluid into and out of said chamber, said valve member including a valve body having a plurality port means, and a spool valve disposed in said valve body for sequentially valving said port means for controlling the flow of activating fluid on one side of said piston while exhausting the fluid on the other side of said piston, and a guide tube connecting said valve body in communication with said bore, said piston rod being in sliding communication with said guide tube, a jaw housing connected to said closure for receiving said ram, said jaw housing having a bifurcated end portion, and a pair of complementary jaw members each having an inner and outer end, a mounting plate, said pair of jaw members being each pivotally connected to said mounting plate at an intermediate point about an axis;

and said mounting plate being secured to said bifurcated end portion, spring means for normally biasing said complementary jaw members in an open position, a cam follower connected to the inner end of each jaw member disposed adjacent said ram, and complementary work engaging means connected to the outer end of said jaw members, said work engaging means including a piercing nose connected to one jaw member, said piercing nose having opposed inclined edges and opposed parallel planar surfaces to define a flat pointed blade so that said blade is substantially rectangular in cross-section, one of said inclined edges being variably angled relative to the other edge, said flat pointed blade being arranged on said outer end of said jaw with the opposed parallel surfaces extending transverse to said axis about which said jaws pivot, and a complementary blade receiving portion connected to the other jaw member, said receiving portion defining a flat blade shot adapted to receive said blade when said jaw members are activated by said ram to a closed position to effect cutting and curling of the displaced material to define a positive mechanical connection, a coil spring means disposed about said flat blade and interposed between said blade and said blade slot for exerting a spring bias between said jaw members subsequent to a securing operation, and a handle means connected to the end wall of said cylinder housing.

* * * * *